United States Patent [19]

Brown et al.

[11] Patent Number: 4,993,692

[45] Date of Patent: Feb. 19, 1991

[54] UNITARY TUNDISH LININGS WITH FLOW-CONTROL DEVICES

[76] Inventors: William K. Brown, 323 Ridge Point Cir., Apt. A34, Bridgeville, Pa. 15017; Thomas W. Lewis, 964 Cork Dr., Bethel Park, Pa. 15102

[21] Appl. No.: 377,176

[22] Filed: Jul. 10, 1989

[51] Int. Cl.[5] ..... C21B 7/14

[52] U.S. Cl. ..... 266/229; 266/280; 266/275

[58] Field of Search ..... 266/275, 280, 281, 286, 266/227, 229; 501/108, 118, 119; 106/121

[56] References Cited

U.S. PATENT DOCUMENTS

| | | | |
|---|---|---|---|
| 4,042,229 | 8/1977 | Eccleston | 266/275 |
| 4,043,543 | 8/1977 | Courtenay et al. | 266/275 |
| 4,839,317 | 6/1989 | Uchida et al. | 501/108 |

FOREIGN PATENT DOCUMENTS

| | | | |
|---|---|---|---|
| 1119622 | 3/1982 | Canada . | |
| 0117778 | 7/1982 | Japan | 501/108 |
| 011272 | 1/1985 | Japan | 501/108 |
| 1281771 | 7/1972 | United Kingdom | 501/108 |

OTHER PUBLICATIONS

Premier ad, *Basilite Gun Coatings* Premier Refractories and Chemicals, Inc.

Dossolite ad, *Doscolite Tundish Spray System.* Harbison-Walker Refractories, Dresser Industries Inc.

*Primary Examiner*—S. Kastler

*Attorney, Agent, or Firm*—Sigalos, Levine & Montgomery

[57] ABSTRACT

A tundish consisting essentially of a rigid metallic outer casing having walls and a bottom at least one permanent layer of heat insulating material adjacent said casing, and a unitary, integrally formed expendable inner lining made of a hydrocarbon-free refractory composition and having at least one liquid metal flow control device integrally formed therewith, the lining being chemically compatible with the molten metal to be placed in the tundish. The invention also comprises the unitary integrally formed expendable lining and the method to form the same.

6 Claims, 1 Drawing Sheet

UNITARY TUNDISH LININGS WITH FLOW-CONTROL DEVICES

BACKGROUND OF THE INVENTION

Tundishes are refractory lined metal boxes conventionally used as a reservoir to control the flow of liquid metals between metal working vessels, such as between a ladle and a continuous caster mold. In recent years there has been an ongoing trend to practice "clean" steelmaking to produce high quality steel grades. To this end, efforts have been made to optimize the design and size of the tundish to control the thermal distribution, the quality, and the flow of steel exiting the tundish and to have expendable refractory linings in the tundish which do not contribute any impurities to the liquid steel.

In addition to the outer casing of the tundish, the steel walls and bottom are conventionally lined with at least one permanent refractory lining, usually refractory brick or castable and an inner expendable refractory lining which must be replaced after every steel pour, or at best after a sequence of up to about 20 steel pours.

In a typical tundish, metal flows into the vessel, fills it to a certain level, and exits through one or more bottom ports sometimes called tundish nozzles. In a typical unpartitioned tundish, the outer rim of the bath inside the tundish is a cooler and stagnant zone because this metal does not mix with the metal entering the tundish. Eventually, when this cooler metal leaves the tundish it can cause either skulling or quality problems downstream. In addition, this type of tundish design creates turbulence particularly when a shroud tube is not used on top of the bath which causes increased heat loss and reoxidation of the liquid steel. To prevent this turbulence, weirs have been installed on either side of the inlet stream. This quiets the bath which decreases the possibility of reoxidation and allows inclusions to float to the top of the bath and to become incorporated into the slag.

One problem associated with use of weirs is that the thermally stagnant zones still exist and some of the incoming metal stream can avoid containment in the tundish and rapidly exit through the bottom ports. These problems are alleviated by use of dams located in the bottom of the tundish in conjunction with the weirs. The dams eliminates a rapid exit from the tundish by forcing the steel stream to move in an upward direction.

Another method of improving the steel flow pattern in tundishes is through the use of tundish baffles in place of the weirs and dams. They combine the effect of dams and weirs by directing steel flow through a series of holes in the baffles. An additional benefit of the baffles are their large surface area onto which nonmetallic inclusions in the steel tend to adhere.

The above tundish linings and flow-control devices have been constructed from magnesite tundish boards which were originally used as tundish liners. These are preformed shapes which often contain resin binders. U.S. Pat. Nos. 4,042,229 and 4,043,543 describe this practice in detail. However, problems arose with use of these boards because of their inadequate strength and corrosion resistance which does not enable them to withstand sequential casts of several hours or more. Another problem with the boards is hydrogen evolution from their resin binder if they are not preheated above 1000° F.

Some facilities have tried to form the dams by using high alumina brick, but installation of brick is expensive and time consuming. Forming weirs with brick would be quite difficult.

Monolithic forming of these flow-control devices is most commonly practiced. Cement bonded 60 to 90% alumina and phosphate-bonded high alumina preformed refractory monoliths are typically utilized in service. Major disadvantages to the use of these flow control shapes are their weight and bulkiness which can result in time-consuming, difficult, and dangerous installations. Oftentimes, the permanent refractory linings in tundishes are in disrepair such that these preformed shapes no longer fit into the intended locations. Another problem with the cast high alumina shapes is that they can be eroded during service and inclusions of the refractory can be trapped in the steel. A further disadvantage is the relatively high cost of these preformed, flow-control shapes.

As to all preformed flow control shapes there is the problem of damage thereto in transit from the point of their manufacture to point of use, the lack of a precise fit in any given tundish shape, and the expense of their installation separate from installation of the expendable tundish lining.

Efforts to utilize expendable linings for tundishes which can be applied by spraying, trowelling, tamping and molding as set forth in Canadian Patent No. 1,119,662 have not been successful. Such linings contain materials which act to contaminate the iron and steel, such as resinous binders and oxidizers such as $Fe_2O_3$.

SUMMARY OF THE INVENTION

The present invention overcomes these problems and provides a rapid, efficient, and cost effective method of providing tundishes with internal flow control devices.

Briefly, the present invention comprises a tundish consisting essentially of a rigid metallic outer casing, at least one layer of a heat insulating material adjacent said casing, and a unitary, integrally formed, expendable lining made of a hydrocarbon-free composition having at least one liquid metal flow control device integrally formed therewith, said lining being chemically compatible with the metal to be poured into the tundish such as a steel or iron. The invention also comprises expendable linings with at least one integrally formed flow control device and method of forming the same as set forth herein.

DETAILED DESCRIPTION

This invention provides forming of flow control devices in situ in an efficient and cost effective manner by using spray mixes. The dams, weirs, and/or baffles are formed in situ at the same time the expendable working lining is formed by spraying.

Figure 1:
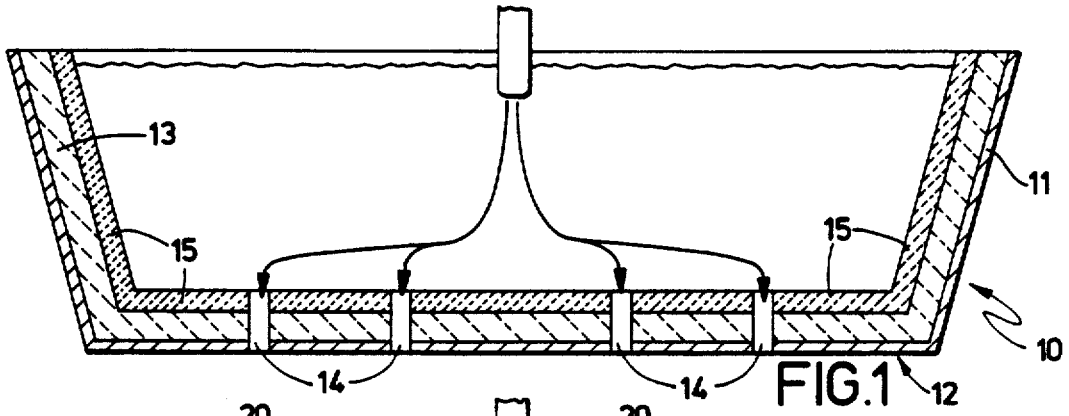
FIG. 1 is an elevational sectional view of an unpartitioned tundish of the prior art without any internal flow-control devices.

FIG. 1, depicts a conventional unpartitioned tundish 10 with a metal outer casing formed by metal walls 11 and metal bottom 12 with a heat insulating lining 13 which is usually formed of refractory brick and is considered to be a permanent lining. A conventional inner expendable lining 15 is placed over the permanent lining. Lining 15 can be a magnesite tundish board or other lining as discussed above. The tundish depicted has four nozzles 14, although it will be obvious that the number of nozzles used in commercial practice varies widely.

Figure 2:
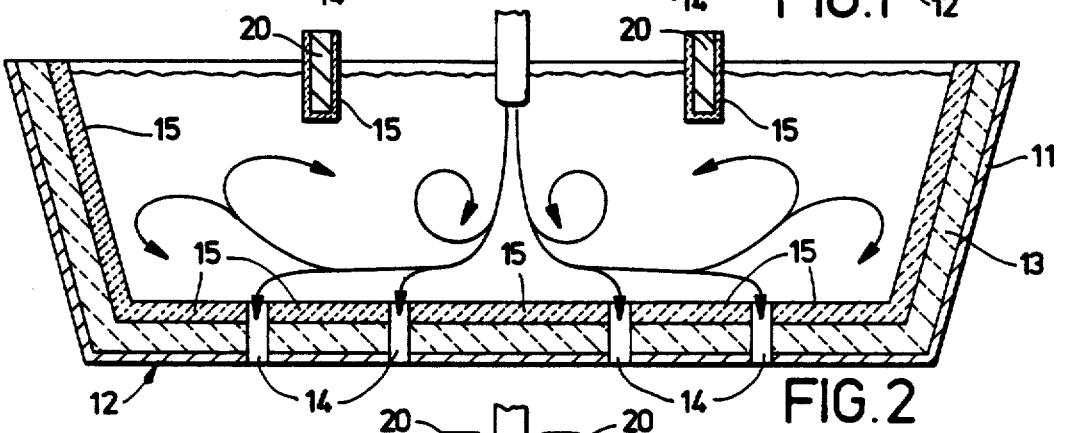
FIG. 2 is an elevational sectional view of a tundish with weirs.
Figure 3:
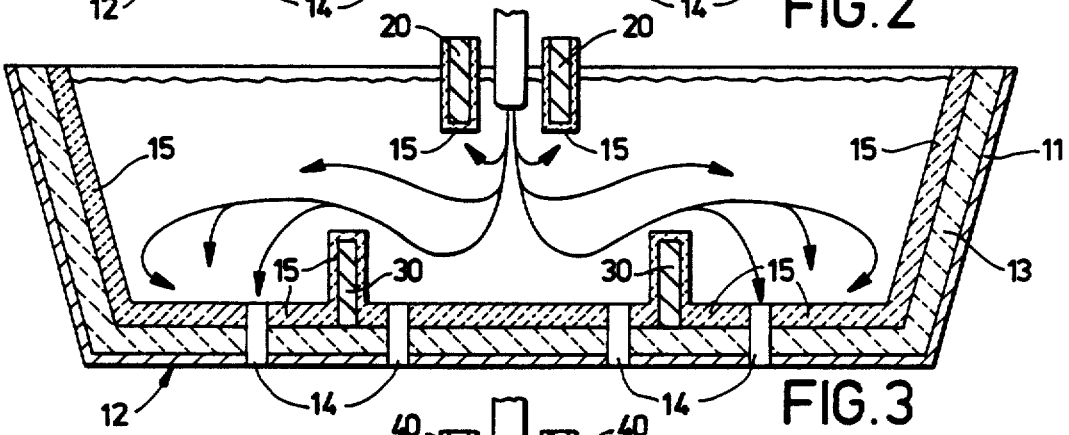
FIG. 3 is an elevational sectional view of a tundish having weirs and dams.
Figure 4:
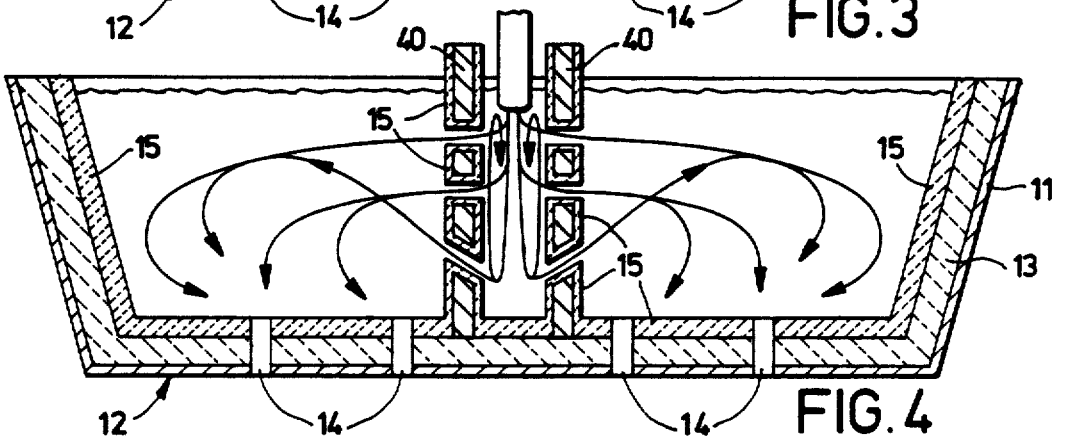
FIG. 4 is an elevational sectional view of a tundish with baffles.

In this figure and also in FIGS. 2, 3, and 4, the steel inlet stream into the tundish is depicted as is the general flow of the steel in solid lines in each tundish showing the general effect of the weirs, dams, and baffles.

To form the weirs as shown in FIG. 2, patterns 20 approximating the shape of the weir and preferably made of a rigid material such as styrofoam, cardboard, wood, or steel are placed across walls 21 of the tundish 22 against the permanent layer 23 in the place where the conventional precast weirs would be installed. The face of the pattern is then sprayed to a given thickness and, if desired, the space between the two walls of patterns 20 filled by pumping with the material being sprayed to form the weir shape. The side walls and bottom of the tundish are sprayed at the same time to form a unitary lining. After the sprayed flow control devices have been dried out, each pattern 20 (if not filled in) can be removed for reuse or left in place and burned out when the liquid steel enters the tundish or during preheating of the tundish or dumped out with the expendable lining when the pour or pours are completed. It will be evident that there can be any number of dams, weirs and baffles, and combination thereof and their location in the tundish is dependent upon the desires of the user.

After a pour or pours of steel is finished the tundish can be tilted to dump out the expendable lining and the process repeated to form a new lining.

The dams 30 depicted in FIG. 3 can be formed in the same manner.

The baffles 40 shown in FIG. 4 may be formed by inserting forms, which have provisions for the desired holes, into the tundish before spraying and then spraying to coat the baffles in the same manner as weirs 20 and dams 30.

The sprayed or pumped dams, weirs, and baffles may be formed to any practical thickness and may incorporate a network of steel re-enforcing bars or steel plate for added strength The advantages of sprayed or pumped in situ formed tundish flow control devices are their relative ease of forming once the pattern of the desired shape has been installed. Spraying or pumping to the desired thickness only takes several minutes and with expenditure of minimal effort. Another advantage of in situ spraying or pumping is that shape thickness can be varied; if a long sequence of casts are expected, greater thickness can be formed and if more aggressive slags are expected, a thicker slagline can be formed. Also, the flow control devices are formed at the same time as the lining eliminating any damage to the lining.

As to the refractory spray mix composition used to form the unitary expendable lining conventional hydrocarbon-free silica/fireclay-based or high alumina-based spray mixes which have high insulating values can be used with some grades of steel, but it is preferred to use a hydrocarbon-free magnesite-based spraying mix since magnesia is chemically compatible with clean steel practices.

It would not be recommended to us, a gunning mix to form the flow control devices because of the inherent high rebounds associated with these mixes, particularly magnesite gunning mixes.

Magnesia is relatively inert against molten steel. An additional advantage of using a magnesite spray mix is the absence of hydrogen pick-up by the steel. This has been reported to be a disadvantage of using tundish boards, which are bonded with a hydrocarbon that liberates hydrogen when in contact with molten steel. Hydrogen is known to be an undesirable contaminant in steel.

Any hydrocarbon-free magnesite-based sprayable composition containing at least about 60% by weight magnesite can be used. Such composition can contain other oxides, such as silica and alumina, and minor amounts of oxides such as lime and iron oxide. Such composition also contain minor amounts of accessory oxides. Particularly preferred are sprayable compositions containing at least 75% by weight magnesia. Dossolite 1400-72 being a specific Example and having the properties and composition shown in Table I below.

TABLE I

| Properties of Dossolite 1400-72 | | |
|---|---|---|
| **Physical Properties** | | |
| Bulk Density, After Drying | | 100 pcf |
| Thermal Conductivity, BTU/HR $Ft^2$ °F./In. @ | 250° F. | 3.1 |
| | 650 | 3.1 |
| | 1000 | 3.4 |
| | 1300 | 3.9 |
| | 1600 | 4.2 |
| **Chemical Analysis** | | % by Wt. |
| Silica ($SiO_2$) | | 16% |
| Alumina ($Al_2O_3$) | | 1.5 |
| Iron Oxide ($Fe_2O_3$) | | 3 |
| Lime (CaO) | | 1 |
| Magnesia (MgO) | | 75 |
| Accessory Oxides | | 1.5 |
| Loss on Ignition, % | | 2 |

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A tundish consisting essentially of a rigid metallic outer casing, at least one layer of permanent heat insulating material adjacent said casing, and a unitary, integrally formed inner expendable lining and at least one expendable liquid metal flow control device of a hydrocarbon-free refractory composition said unitarily formed expendable lining and control device being structured so as to be removable from the tundish at the same time and, said composition being chemically compatible with the molten metal to be placed in the tundish.

2. The tundish of claim 1, wherein said metal flow device is one or more of a baffle, weir, or dam and said composition is made of a sprayable mix containing at least about 60% by weight magnesia, alumina, silica/fireclay, or mixtures thereof.

3. The tundish of claim 2, wherein said mix contains at least about 75% by weight magnesia.

4. A unitary, integrally formed expendable unitary tundish lining and at least one expendable liquid metal flow control device for the interior of a tundish consisting essentially of a hydrocarbon-free refractory composition, said composition being chemically compatible with the molten metal to be placed in the tundish.

5. The expendable lining of claim 4 wherein said metal flow control device is a baffle, weir, and/or dam and said composition is made of a sprayable mix containing at least about 60% by weight magnesia, alumina, silica/fireclay, or mixtures thereof.

6. The tundish of claim 5, wherein said mix contains at least about 75% by weight magnesia.

* * * * *